US008330704B2

(12) United States Patent
Lin et al.

(10) Patent No.: US 8,330,704 B2
(45) Date of Patent: Dec. 11, 2012

(54) BACKLIGHT CONTROL METHOD FOR HIGH DYNAMIC RANGE LCD

(75) Inventors: Fang-Cheng Lin, Hsin-Chu (TW); Cheng-Yu Liao, Hsin-Chu (TW); Lin-Yao Liao, Hsin-Chu (TW); Yi-Pai Huang, Hsin-Chu (TW); Te-Mei Wang, Hsin-Chu (TW); Han-Ping Shieh, Hsin-Chu (TW)

(73) Assignee: AU Optronics Corporation, Hsin-Chu (TW)

( * ) Notice: Subject to any disclaimer, the term of this patent is extended or adjusted under 35 U.S.C. 154(b) by 907 days.

(21) Appl. No.: 11/896,378

(22) Filed: Aug. 31, 2007

(65) Prior Publication Data

US 2008/0180383 A1 Jul. 31, 2008

(30) Foreign Application Priority Data

Jan. 26, 2007 (TW) ..... 96103083 A

(51) Int. Cl.
*G09G 3/36* (2006.01)

(52) U.S. Cl. ..... 345/102; 345/89; 345/609

(58) Field of Classification Search ..... 345/77, 345/87, 89, 102, 609, 617
See application file for complete search history.

(56) References Cited

U.S. PATENT DOCUMENTS

| | | | | |
|---|---|---|---|---|
| 6,891,672 | B2 | 5/2005 | Whitehead et al. | |
| 7,064,740 | B2 | 6/2006 | Daly | |
| 7,269,293 | B2 * | 9/2007 | Wang et al. | 382/254 |
| 7,505,016 | B2 * | 3/2009 | Kwon | 345/87 |
| 7,684,638 | B2 | 3/2010 | Hsu et al. | |
| 7,773,265 | B2 * | 8/2010 | Hata et al. | 358/3.01 |
| 7,782,281 | B2 | 8/2010 | Oh et al. | |
| 2004/0170308 | A1 * | 9/2004 | Belykh et al. | 382/128 |
| 2005/0226531 | A1 * | 10/2005 | Silverstein et al. | 382/284 |
| 2006/0082689 | A1 * | 4/2006 | Moldvai | 348/678 |
| 2006/0139270 | A1 * | 6/2006 | Hong et al. | 345/87 |
| 2006/0146174 | A1 * | 7/2006 | Hagino | 348/349 |
| 2006/0204124 | A1 * | 9/2006 | Aihara | 382/274 |
| 2007/0229445 | A1 * | 10/2007 | Park et al. | 345/102 |

FOREIGN PATENT DOCUMENTS

| | | |
|---|---|---|
| TW | 535126 | 6/2003 |
| TW | 200525480 | 8/2005 |
| TW | 200530996 A | 9/2005 |
| TW | 200622980 | 7/2006 |
| TW | 200629232 A | 8/2006 |

* cited by examiner

*Primary Examiner* — Amare Mengistu
*Assistant Examiner* — Premal Patel
(74) *Attorney, Agent, or Firm* — Rabin & Berdo, P.C.

(57) ABSTRACT

A cumulative function of image is obtained according to its gray levels of pixels. This function is then mapped to obtain a backlight modulation function according to a reference line. The backlight brightness provided for different regions of the liquid crystal display are decided by the backlight modulation function while displaying the images.

12 Claims, 2 Drawing Sheets

BACKLIGHT CONTROL METHOD FOR HIGH DYNAMIC RANGE LCD

RELATED APPLICATIONS

This application claims priority to Taiwan Application Serial Number 96103083, filed Jan. 26, 2007, which is herein incorporated by reference.

BACKGROUND OF THE INVENTION

1. Field of Invention

The invention relates to a liquid crystal display (LCD) and, in particular, to a backlight control method for a high dynamic range LCD.

2. Related Art

Conventional high dynamic range display technology involves one light source, two modulators, and an optical structure between them and is used to control the backlight brightness in different regions of the display. By controlling the backlight brightness in each region, the high dynamic range display technology can increase the dynamic range or contrast of the display. However, because the backlight brightness is reduced, the image distortion occurs with the increasing contrast. Currently, there are two methods for determining the backlight brightness in each region. The first is to determine the backlight brightness according to the average gray level of all pixels in a region. The second is to take the square root of the average gray level computed in the first method to enhance the backlight brightness. Nevertheless, the image obtained using these conventional backlight control methods still has image distortion in the detailed parts.

SUMMARY OF THE INVENTION

According to an embodiment of the invention, the backlight control method first determines the gray level histogram in the pixels of an image. Afterwards, the histogram is accumulated to obtain a cumulative function of the image. The cumulative function is mapped with respect to a standard line to obtain a backlight modulation function. Finally, the backlight brightness for different regions of the LCD is determined according to the backlight modulation function.

According to another embodiment of the invention, the backlight control method of the LCD receives several images and obtains a mapping function according to the gray levels of pixels in each image. Afterwards, the mapping function is mapped with respect to a standard line to obtain a backlight modulation function. The backlight brightness provided for different regions of the LCD are decided by the backlight modulation function while displaying the images.

BRIEF DESCRIPTION OF THE DRAWINGS

These and other features, aspects and advantages of the invention will become apparent by reference to the following description and accompanying drawings which are given by way of illustration only, and thus are not limitative of the invention, wherein.

DETAILED DESCRIPTION OF THE INVENTION

The present invention will be apparent from the following detailed description, which proceeds with reference to the accompanying drawings, wherein the same references relate to the same elements.

The backlight brightness in each region of an image is adjusted according to the properties thereof. In addition to merely enlarging the gray level difference between the highest and lowest ones in each region, the difference between adjacent gray levels is reduced. More explicitly, this embodiment uses a mapping function of the image as its basis. This function is mapped with respect to a standard line with an appropriate slope to obtain the backlight module function for the backlight brightness in different regions. In comparison with the two conventional backlight control methods in the prior art, the invention can highlight the details of an image.

Figure 1:
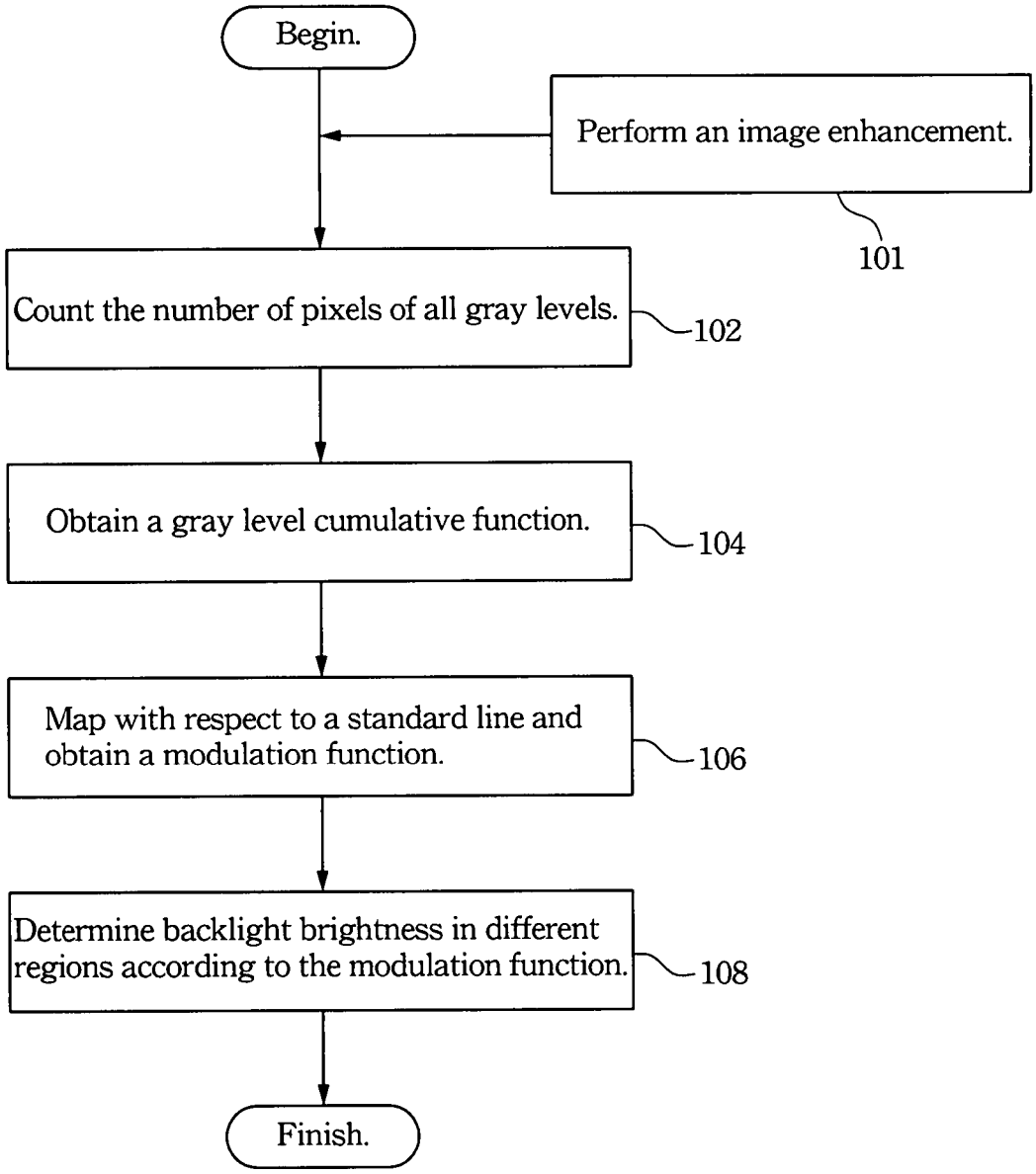
FIG. 1 is a flowchart of the disclosed method according to an embodiment.

As shown in FIG. 1, the method according to an embodiment of the invention first determines the histogram of gray levels in an image (step 102). The pixel numbers are accumulated to obtain a cumulative function of the image (step 104). Afterwards, the cumulative function is mapped with respect to a standard line to obtain a backlight modulation function (step 106). Finally, the backlight brightness for different regions is decided according to the backlight modulation function (step 108).

Before determining the histogram mentioned above, one can perform an image enhancement on the image (step 101), which can be noise reduction, video focus assessment, or gray level histogram equalization. Moreover, this embodiment accumulates the number of pixels from low gray levels to high gray levels, including pixels of different colors. In other embodiments of the invention, the number of pixels can be accumulated from high gray levels to low gray levels as well. The standard line y=x used in this embodiment has a unit slope. Any person skilled in the art can select an appropriate standard line or a set of standard lines according to the specification of the LCD, the customer's needs, and the image types for mapping the cumulative function to obtain the backlight modulation function.

More explicitly, this embodiment adjusts the backlight brightness of a region according to the number generated by the backlight modulation function for the image content in the region. For example, the input of the backlight modulation function can be the average gray level, the maximum gray level, the mean gray level, or some other representative gray level.

In other words, the disclosed method first receives several images and obtains the mapping function of the image according to the gray levels of pixels in the image. Afterwards, the mapping function is mapped with respect to a standard line to obtain a backlight modulation function. The backlight brightness for different regions is decided according to the backlight modulation function.

In the following, a set of experimental data is used to explain the actual operation of the above embodiment. The experimental image is a complete frame of image shown on the display. It contains the gray levels of 2,073,600 pixels. First, according to step 102, the numbers of pixels in all gray levels are determined. This embodiment obtains the histogram of pixels of all gray levels (0~255). This histogram contains the information of each gray level histogram in the experimental image. The results are shown in Table 1.

TABLE 1

Histogram of gray levels.

| Gray Level | Number |
|---|---|
| 0 | 459252 |
| 1 | 143387 |
| 2 | 26455 |
| 3 | 21219 |
| 4 | 20429 |
| 5 | 19437 |
| ... | ... |
| ... | ... |
| ... | ... |
| 253 | 6456 |
| 254 | 3190 |
| 255 | 3140 |

Afterwards, according to step 104, the pixel numbers of the above gray levels are accumulated to obtain the cumulative function. That is, the gray level histogram in Table 1 is accumulated from lower gray levels to high gray levels to obtain the cumulative function. The cumulative results are shown in Table 2.

TABLE 2

Cumulative function of gray levels.

| Gray Level | Number |
|---|---|
| 0 | 459252 |
| 1 | 602639 |
| 2 | 629094 |
| 3 | 650313 |
| 4 | 670742 |
| 5 | 690179 |
| ... | ... |
| ... | ... |
| ... | ... |
| 253 | 2067270 |
| 254 | 2070460 |
| 255 | 2073600 |

The cumulative function in Table 2 still contains the information of gray level histogram in the entire experimental image. The number of pixels at each gray level can be rescaled back to 0~255, rendering a gray level cumulative function. The rescaling is more convenient in use. More explicitly, the number of pixels accumulated in each gray level is first divided with the total number of pixels and then multiplied by 255. The rescaled results are shown in Table 3.

TABLE 3

Rescaled cumulative function of gray levels.

| Gray Level | Rescaled Value |
|---|---|
| 0 | 56 |
| 1 | 74 |
| 2 | 77 |
| 3 | 80 |
| 4 | 82 |
| 5 | 85 |
| ... | ... |
| ... | ... |
| ... | ... |
| 253 | 254 |
| 254 | 255 |
| 255 | 255 |

Afterwards, according to step 106, the rescaled gray level cumulative function is mapped with respect to the standard line y=x to obtain the backlight modulation function. The mapped results are shown in Table 4.

TABLE 4

Backlight modulation function.

| Gray Level | Mapped Value |
|---|---|
| 0 | 0 |
| 1 | 0 |
| 2 | 0 |
| 3 | 0 |
| 4 | 0 |
| 5 | 0 |
| ... | ... |
| ... | ... |
| ... | ... |
| 253 | 252 |
| 254 | 253 |
| 255 | 255 |

Finally, according to step 108, the backlight brightness for different regions is decided according to the backlight modulation function. In this embodiment, the backlight brightness for different regions is decided according to the value of the backlight modulation function for the maximum gray level of each region. The original backlight brightness and the adjusted backlight brightness of each region are given in Table 5.

TABLE 5

Comparison of the backlight brightness before and after adjustment.

| Original Backlight Brightness | New Backlight Brightness |
|---|---|
| 72 | 1 |
| 74 | 1 |
| 97 | 11 |
| 98 | 11 |
| 100 | 12 |
| 119 | 22 |
| ... | ... |
| ... | ... |
| ... | ... |
| 253 | 252 |
| 254 | 253 |
| 255 | 255 |

Figure 2:
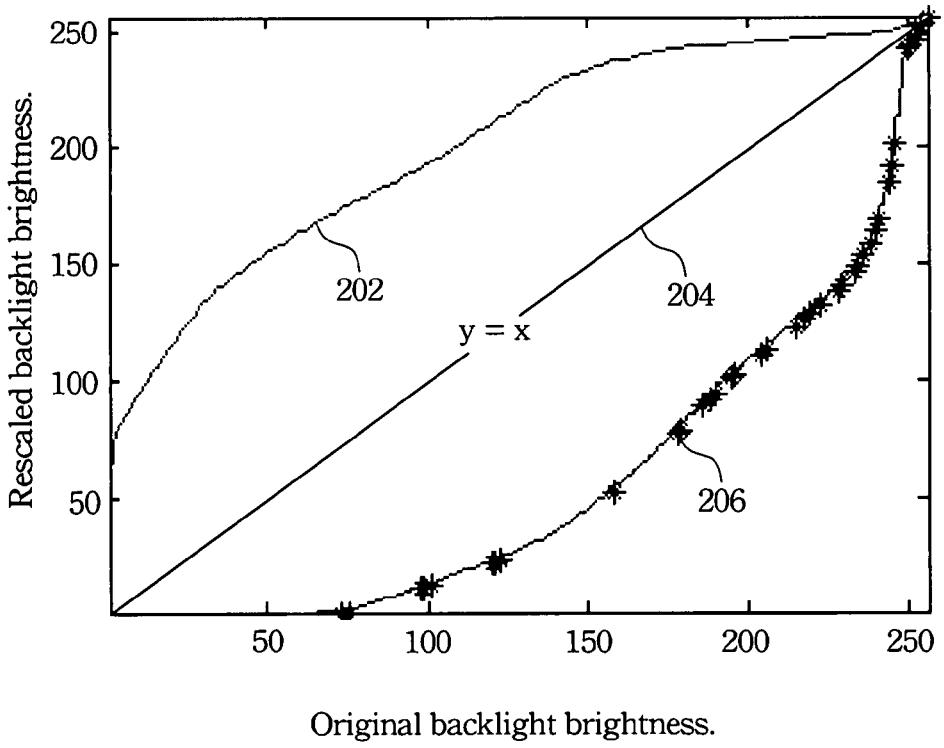
FIG. 2 shows the rescaled cumulative function and backlight modulation function according to the embodiment in FIG. 1.

FIG. 2 shows the cumulative function and the backlight modulation function in Tables 3 and 4. The curve 202 is the cumulative function in Table 3. The standard line 204 for mapping is y=x. The curve 206 is the backlight modulation function. The horizontal and vertical axes of FIG. 2 represent the original backlight brightness and the corresponding adjusted backlight brightness (stars on curve 206) in each region, corresponding to the results in Table 5.

In summary, the method according to the embodiment can use different backlight modulation functions for different images. This is different from the conventional backlight modulation method that uses a single curve. Therefore, the invention can expand the backlight brightness of a high contrast image to increase its dynamic range, as well as homogenize the brightness of a low contrast image (regardless of whether it is a low gray level image, a middle gray level image, or a high gray level image). Consequently, the backlight control method of the invention can easily highlight details in an image.

While the invention has been described by way of example and in terms of the preferred embodiment, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method for controlling backlight of a liquid crystal display (LCD), comprising the steps of:

determining the number of pixels at each gray level for an image;

accumulating the determined pixel numbers at all gray levels to obtain a first gray level cumulative function of the image;

calculating a backlight modulation function according to the first gray level cumulative function, wherein a standard line maps the first gray level cumulative function to a second gray level cumulative function as the backlight modulation function, wherein the slope of the standard line is 1; and determining backlight brightness for different regions of the LCD according to the backlight modulation function.

2. The method of claim 1 further comprising the step of performing image enhancement before the step of determining the number of pixels.

3. The method of claim 1, wherein the pixel numbers are accumulated from low gray levels to high gray levels.

4. The method of claim 1, wherein the backlight brightness of a region is modulated according to the value of the backlight modulation function for image content in the region.

5. The method of claim 1, wherein the backlight brightness of a region is modulated according to the value of the backlight modulation function for the mean gray level in the region.

6. The method of claim 1, wherein the backlight brightness of a region is modulated according to the value of the backlight modulation function for the maximum gray level in the region.

7. A method for controlling backlight of a liquid crystal display (LCD), comprising the steps of:

receiving a plurality of images;

calculating a mapping function for each of the images according to gray levels of pixels in each image, wherein the mapping function is calculated by determining the number of pixels at each gray level and accumulating the determined pixel numbers at all gray levels to obtain a first gray level cumulative function of each image as the mapping function;

calculating a backlight modulation function according to the mapping function, wherein a standard line maps the first gray level cumulative function to a second gray level cumulative function as the backlight modulation function, wherein the slope of the standard line is 1; and determining the backlight brightness for different regions of the LCD according to the backlight modulation function when displaying the image.

8. The method of claim 7, wherein the pixel numbers are accumulated from low gray levels to high gray levels.

9. The method of claim 7, wherein the backlight brightness of a region is modulated according to the value of the backlight modulation function for image content in the region.

10. The method of claim 7, wherein the backlight brightness of a region is modulated according to the value of the backlight modulation function for the mean gray level in the region.

11. The method of claim 7, wherein the backlight brightness of a region is modulated according to the value of the backlight modulation function for the maximum gray level in the region.

12. A method for controlling backlight of a liquid crystal display (LCD), comprising the steps of:

determining the number of pixels at each of a plurality of gray levels for an image;

accumulating the determined pixel numbers at the plurality of gray levels to obtain a first gray level cumulative function of the image;

calculating a backlight modulation function according to the first gray level cumulative function, wherein the backlight modulation function and the first gray level cumulative function are symmetric with respect to a standard line, wherein the slope of the standard line is 1; and determining backlight brightness for different regions of the LCD according to the calculated backlight modulation function.

* * * * *